US008203581B2

(12) United States Patent
Garcia et al.

(10) Patent No.: US 8,203,581 B2
(45) Date of Patent: Jun. 19, 2012

(54) METHOD OF LED DIMMING USING AMBIENT LIGHT FEEDBACK

(75) Inventors: Richard Jeff Garcia, Beaumont, CA (US); Michael Patrick Babb, Corona, CA (US)

(73) Assignee: Janlincia LLC, Yucaipa, CA (US)

( * ) Notice: Subject to any disclaimer, the term of this patent is extended or adjusted under 35 U.S.C. 154(b) by 486 days.

(21) Appl. No.: 12/319,481

(22) Filed: Jan. 7, 2009

(65) Prior Publication Data

US 2010/0171429 A1 Jul. 8, 2010

(51) Int. Cl.

| | |
|---|---|
| ***G09G 5/10*** | (2006.01) |
| ***H05B 37/02*** | (2006.01) |
| ***H05B 39/04*** | (2006.01) |
| ***H05B 41/36*** | (2006.01) |

(52) U.S. Cl. ..... 345/691; 315/149; 315/291

(58) Field of Classification Search ..... 315/DIG. 4; 323/905; 375/238

See application file for complete search history.

(56) References Cited

U.S. PATENT DOCUMENTS

| | | | | |
|---|---|---|---|---|
| 7,608,807 | B2 * | 10/2009 | Hick et al. | 250/205 |
| 2002/0118538 | A1 * | 8/2002 | Calon et al. | 362/236 |
| 2007/0108846 | A1 * | 5/2007 | Ashdown | 307/149 |

* cited by examiner

*Primary Examiner* — Jacob Y Choi
*Assistant Examiner* — Henry Luong

(57) ABSTRACT

An improved means of measuring ambient light and controlling light sources based on those measurements. This embodiment of measuring ambient light, and only ambient light, by selectively turning off any LED light sources that the device controls and then using an ambient light sensor [12] to measure the remaining light. All of this must be done in such a way as to be undetected by people who are using the light for various purposes.

26 Claims, 2 Drawing Sheets

METHOD OF LED DIMMING USING AMBIENT LIGHT FEEDBACK

CROSS-REFERENCE TO RELATED APPLICATIONS

Background of the Invention

1. Field

This invention generally relates to light sensing and control, specifically to light sensing in LED lighting applications.

2. Prior Art

Previously there have been several different means of using sensors to either dim lighting or to turn off lights as necessary. A classic example would be using low cost CdS, or cadmium sulphide, cells. Other examples use LEDs themselves as sensors, and yet other examples use photo diodes.

For lighting fixtures that use light sensors for either on/off control or for dimming the problem has been keeping the light emitted from the fixture from interfering with the light measurements. This is generally accomplished by shielding the sensor from the emitted light, or positioning it outside the lighted area of the fixture. While this is both low cost and effective, not all fixtures lend themselves to having a separately positioned sensor. For example consider a light that faces up and is embedded in concrete, often called an "uplight", that might be used to illuminate a tree or other landscape feature. This light might benefit from having a light sensor but there isn't an easy place to put a light sensor such that the light from the fixture itself doesn't interfere with light measurements.

Part of the reason why the shielding approach is popular is because lighting is primarily done with incandescent, fluorescent, and high intensity discharge (HID). These technologies cannot be rapidly cycled on and off, so rapidly taking light measurements with the light off is not an option. Moreover CdS cells, which have traditionally been the most cost effective means of light sensor, are too slow for rapid cycling. While photo diodes are fast, they suffer from being sensitive to non-visible light such as infra red. Adding special films to filter out infra red adds cost and complexity.

There is prior art related to color measurements using LEDs as the light sensor. The idea was using specific colors of LEDs to determine if specific colors were present by using the properties of an LED to operate as a color sensor for the color of light that the LED produced. For example, green LEDs would react if green light was present, while red LEDs would only react if red light was present. This approach is good for color measurement but is different from the current invention which is based on white light. LEDs that produce white light cannot be used to detect white light. This is because white light from an LED is produced in a two step process. First blue light is generated to excite a phosphor coating, which then produces white light. While using an LED as a low cost color sensor has been explored and is noted in the prior art, it is very different from what this invention accomplishes and is not suited to general lighting applications which want to sense light in all visible colors.

ADVANTAGES OVER PRIOR ART

The prior art includes light sensors but they had some limitations such as requiring optical shielding or being too slow to operate in the manner that this invention does. For general lighting, where white LEDs are typically used, it is ideal to have the light sensor mounted near, or even on the same PCB board, as the LEDs themselves. This would normally mean that the light from the LEDs would interfere with the light measurements however by using the techniques of this embodiment light measurements can be taken in such a way that the human eye cannot tell the difference. This means that lower cost intelligent lighting that saves energy is enabled. This also opens up a variety of new form factors for the lighting fixtures since designers no longer need to have an optically shielded area if lighting sensors are desired. A good example is the uplight mentioned earlier. One version of an uplight just has a lense facing up and a small bezel around it for waterproofing. There is no easy place that is shielded from the light source to put a light sensor without adding to the cost or taking away from the uniformity of the light (or both). One embodiment of the new invention solves just this problem.

Another advantage over the prior art is that the prior art used the same LEDs for both emitting light and detecting light. This is a good method for colored light, which was the intended application, but does not work well for white light. Additionally, the techniques for using LEDs as light sensors means that the control circuit cannot be used with any light engine. If the LEDs are to be used as light sensors, they inherently must be tied to the control circuitry. Unlike the prior art, the new invention can be applied to any existing LED light fixture without requiring connections to specific LEDs. This opens the possibility of retrofitting existing LED light fixtures easily. Finally, the prior art that turned the LEDs off to take readings required that the many readings be taken per second so that the flicker was not noticed. Unlike the prior art, the embodiments described for this invention do not have this requirement.

SUMMARY

In accordance with one embodiment, this invention allows one or more light sensor to measure ambient light and control a LED light source without that light source interfering with the light measurements that said light sensors are taking.

DRAWINGS—FIGURES

DRAWINGS—REFERENCE NUMERALS

Figure 1:
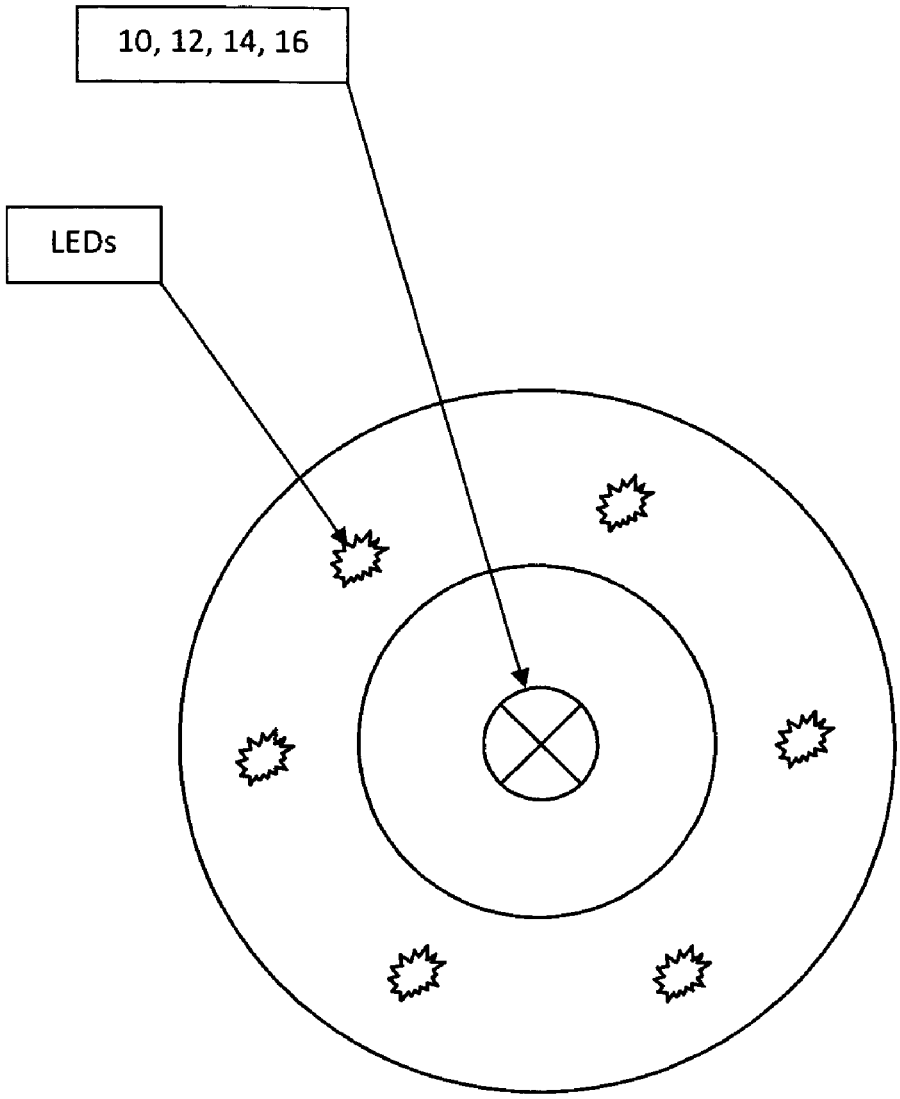
FIG. 1 is a top view of a typical LED based light ring with a light sensor in the center of the light ring.

Detailed Description—FIG. 1

FIG. 1 shows a typical light ring, which in this case is simply a PCB board with some LEDs mounted on it, along with one embodiment of the invention in the middle of the light ring. An example of this type of light ring is part number LXHL-NWE7 manufactured by Lumileds. Said embodiment is comprised of a PCB board 10, an ambient light sensor 12, a microcontroller 14, and a solid state switch 16. Note that the sensor is not required to be shielded from the LEDs. Sensor 12, microcontroller 14, and solid state switch 16 are all mounted on PCB board 10.

Figure 2:
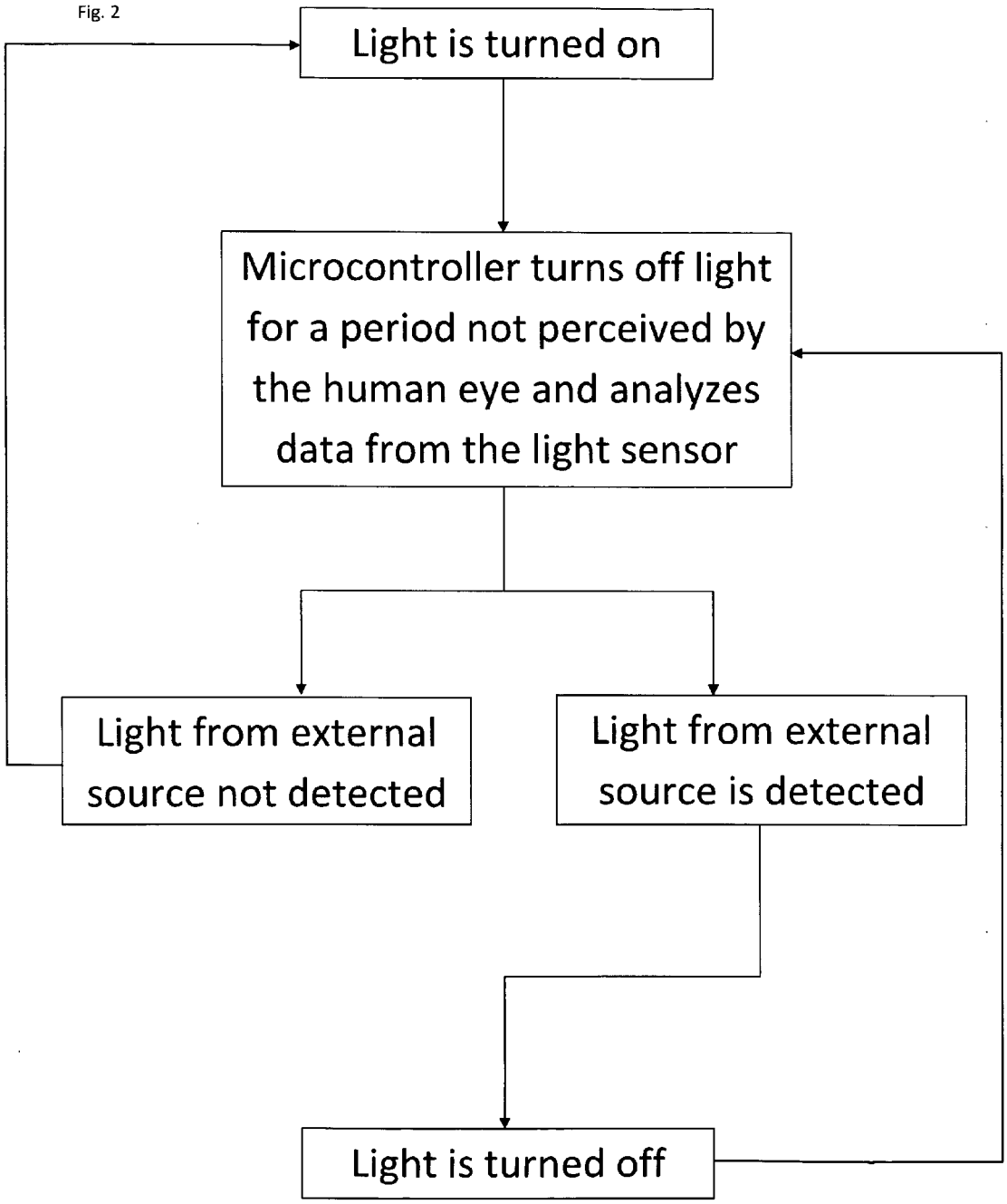
FIG. 2 is a flow chart that shows one method of implementing the invention

Detailed Description—FIG. 2

FIG. 2 shows a flowchart that describes how the embodiment of FIG. 1 works. Here is a detailed description of that flowchart. Initially power is on and the LEDs are emitting light. Microcontroller 14 uses solid state switch 16 to turn off the power, so that the LEDs turn off. Next the microcontroller takes a reading from ambient light sensor 12. To take said light reading, microcontroller 14 allows sufficient time for ambient light sensor 12 to adapt to the light level with said LEDs off. Based on the light reading from ambient light sensor 12 microcontroller 14 can determine to either keep said LEDs off or to turn said LEDs back on depending on how much external (ie non-LED) light is detected.

Operation

First Embodiment

The first embodiment follows the operation detailed in FIG. 2. The process being that the LEDs are first turned off using solid state switch 16. In the first embodiment solid state switch 16 was a transistor. Next microcontroller 14 uses ambient light sensor 12 to measure how much light is present with the LEDs off. The first embodiment used an analog ambient light sensor 12 and the analog to digital peripheral of microcontroller 14 to take the light measurement. Next microcontroller 14 either turns said LEDs back on using switch 16 if little or no light was detected by ambient light sensor 12 or keeps said LEDs off using switch 16 if enough ambient light was detected that additional light is not required. The key to this process is that everything must happen fast enough to not be noticed by the human eye. Said embodiment is able to accomplish this. Dimming is accomplished by simply applying the principle of pulse width modulation, PWM, to how long the solid state switch 16 is off and on.

Operation

Alternate Embodiments

There are several possible alternate embodiments from the first embodiment described. These possibilities include using various technologies for solid state switch 16, including NPN or PNP transistors or N channel or P channel MOSFETS. Digital or analog ambient light sensors are available from various manufacturers for ambient light sensor 12. Microcontroller 14 could conceivable be replaced with discrete components or an ASIC. Dimming could be accomplished by means other than using solid state switch 16 for PWM, such as applying industry standard dimming interfaces such as the 0-10V interface, applying a PWM output for the LED driver, etc.

Perhaps the most interesting alternative embodiment is using the off part of a PWM duty cycle as the time to take the light reading from ambient light sensor 12. The LED driver could either have an integrated light sensor or the light sensor could sense when the power to the LEDs has been turned off. This might allow for the solid state switch 16 to be removed as long as the duty cycle didn't go to 100%.

CONCLUSION, RAMIFICATIONS, AND SCOPE

Accordingly the reader will see that, according to one embodiment of the invention, the LED light sensing controller allows for control of any LED fixture or light engine with no limitations on light sensor placement and that can be applied for either on/off control or for dimming the light output.

While my above description contains many specificities, these should not be construed as limitations on the scope, but rather as an exemplification of one preferred embodiment thereof. Many other variations are possible. For example, microcontroller 14 could be from a large variety of manufacturers.

We claim:

1. A lighting control system comprising a lighting control circuit configured to adjust the light based on measured ambient light, with said lighting control system comprised of a control means for switching the light off or dimming it sufficiently for negligible affect on the light sensor, a light sensor for measuring the remaining ambient light once the lighting control has reduced the light being controlled to a negligible amount, a microcontroller for processing said measured ambient light, to turn the controlled light off or dim the controlled light sufficiently for negligible affect on the light sensor before taking a light measurement thus only measuring the non-controlled ambient light, then turning the controlled light back on with the intensity of the controlled light being adjusted based on the previously measured ambient light.

2. The lighting control circuit according to claim 1, where an ambient light sensor is used as the means for detecting or measuring light.

3. The lighting control circuit according to claim 1, where the control means for switching the light is a solid state switch.

4. The lighting control circuit according to claim 1, where the means for processing the measured light is an analog to digital converter.

5. The analog to digital converter according to claim 4 is part of a microcontroller or ASIC.

6. The lighting control circuit according to claim 1, where a microcontroller is used for adjusting the light based on the measured ambient light by outputting a pulse width modulation signal (PWM).

7. The lighting control circuit according to claim 1, where the measurement process is not detectable because it happens too fast for the eye to detect.

8. The lighting control circuit according to claim 1, where the measurement process is not detectable because it happens more than 30 times per second, so that the flicker is not detectable.

9. An energy conservation circuit comprising:

a lighting control, a light sensor, of measuring only ambient light by first turning off, or reducing until it will have negligible affect on the light sensor, the controlled light before taking a light measurement then turning the controlled light source back on once the measurement is completed.

10. The energy conservation circuit of claim 9, where the means of controlling the light source is a solid state switch.

11. The energy conservation circuit of claim 9, where the means of controlling the light source is a BJT transistor.

12. The energy conservation circuit of claim 9, where the means of controlling the light source is a MOSFET.

13. The energy conservation circuit of claim 9, where the means of measuring ambient light is comprised of an analog light sensor and the analog to digital peripheral on a microcontroller.

14. The light sensor of claim 13, where the analog light sensor is a photodiode.

15. The energy conservation circuit of claim 9, where the means of measuring ambient light is comprised of a digital light sensor and a microcontroller.

16. The energy conservation circuit of claim 9, where the means of adjusting the controlled light source is adjusting the duty cycle using pulse width modulation.

17. The energy conservation circuit of claim 9, where the controlled light can be turned off, a measurement taken of just the remaining ambient light, and the resulting measurement processed so as not be noticed by the human eye.

18. The energy conservation circuit of claim 9, where the controlled light can be turned off, a measurement taken of just the remaining ambient light, and the resulting measurement processed more than 30 times per second so as not to cause a visible flicker.

19. The lighting control circuit of claim 1, where the lighting control circuit is integrated into the same unit as the light being controlled.

20. The lighting control circuit of claim 1, where the lighting control circuit is integrated onto the same PCB board as the lights being controlled.

21. The lighting control circuit of claim 1, where the lighting control circuit is integrated into the circuit that powers the lights being controlled.

22. The energy conservation circuit of claim 9, where the lighting control circuit is integrated into the same unit as the light being controlled.

23. The energy conservation circuit of claim 9, where the lighting control circuit is integrated onto the same PCB board as the lights being controlled.

24. The energy conservation circuit of claim 9, where the lighting control circuit is integrated into the circuit that powers the lights being controlled.

25. A method for measuring only ambient light for a system that has both an LED lighting control that can vary a LEDs intensity and a light sensor where by first turning off, or dimming to the point of negligible influence on the light sensor, the controlled LED light, then measuring the remaining ambient light with a light sensor, then turning the controlled light back to its original intensity.

26. The method of claim 25 where instead of returning the controlled light to the original intensity after taking the light sensor reading the controlled light is instead set to a new intensity based on the measured ambient light.

* * * * *